US005474509A

United States Patent [19]

Hodgdon

[11] Patent Number: 5,474,509

[45] Date of Patent: Dec. 12, 1995

[54] ADJUSTABLE EXERCISE PLATFORM

[75] Inventor: Darren W. Hodgdon, Glencoe, Ill.

[73] Assignee: Athletic Clubs of America, Chicago, Ill.

[21] Appl. No.: 98,883

[22] Filed: Jul. 29, 1993

[51] Int. Cl.[6] ..... A63B 21/00

[52] U.S. Cl. ..... 482/52; 482/51; 482/142

[58] Field of Search ..... 482/51, 52, 123, 482/130, 904, 148, 140, 142, 133

[56] References Cited

U.S. PATENT DOCUMENTS

| | | | |
|---|---|---|---|
| 2,097,273 | 10/1937 | Feist | 482/52 |
| 3,628,790 | 12/1971 | Gordon | 482/23 |
| 4,478,413 | 10/1984 | Siwula | 482/133 |
| 4,678,234 | 7/1987 | Wilson | 297/439 |

OTHER PUBLICATIONS

"The Step®, The Professional Club Model," published by The Step Company in 1993.

"The Step®," an advertisement published by The Step Company in Circle Reader Service No. 54.

"The Step Challenge '92," an advertisement published by The Step Company.

"Step Reebok" an advertisement published by Reebok International, Ltd. in 1993.

"Jane Fonda's Step Aerobic And Abdominal Workout™," published by Fitness Quest® in 1992.

*Primary Examiner*—Richard J. Apley
*Assistant Examiner*—Jerome Donnelly
*Attorney, Agent, or Firm*—Marshall, O'Toole, Gerstein, Murray & Borun

[57] ABSTRACT

An exercise platform for use in a stair-step exercise routine and which is capable of supporting a person at a plurality of heights above a floor, includes a base section having first and second upwardly facing flat surfaces at first and second heights above a floor, and a riser section which is supported by the base section and includes third and fourth flat, oppositely facing surfaces. The riser section is connected to the base section with a hinge and is movable between first and second positions such that the third surface is upwardly disposed and located at a third height when the riser section is in the first position, and such that the fourth surface is upwardly disposed and located at a fourth height when the riser section is in the second position. Furthermore, a high friction coefficient material is disposed on the first, second, third and fourth surfaces to prevent slippage between the exercise platform and a foot of a person using the exercise platform.

21 Claims, 2 Drawing Sheets

ADJUSTABLE EXERCISE PLATFORM

TECHNICAL FIELD

The present invention relates generally to exercise platforms, and more particularly to an exercise platform which is adjustable in height and capable of being used in a stair-step exercise routine.

BACKGROUND ART

A stair-step exercise routine is one in which a person steps onto and off of an exercise platform in a repeated motion in order to simulate the exercise of walking or running up a set of stairs. The difficulty of the exercise is determined, among other things, by the height of the platform used during the exercise routine. Specifically, the higher the platform, the more difficult the stair-step exercise routine tends to be. Thus, the height of the platform used by any particular individual depends upon that individual's level of skill, endurance and on the amount of workout desired.

Stair-step exercise routines are typically performed at health clubs or other exercise facilities by a group of people who, simultaneously, step onto and off of either the same or different exercise platforms. Because not everyone in the group has the same level of endurance or desires the same level of workout, a number of different height exercise platforms are required to satisfy the needs of all the individuals within any particular group performing a stair-step exercise routine.

Presently, most stair-step exercise platforms consist of a number of prefabricated boards stacked on top of one another so as to make a platform of any desired height. Typically, however, these boards are long, bulky, heavy and must be stored at a location away from the exercise area when the boards are not being used as part of the platform. These features make it difficult and time-consuming to reconfigure the exercise platform in order to adjust the height thereof, either before or during any particular stair-step exercise routine. Furthermore, all the people using a particular platform must agree as to the specific height of the platform before any reconfiguration can be performed. Thus, it is desirable to have an individual stair-step exercise platform which is easily adjustable in height.

Although some individual, height adjustable stair-step exercise platforms are known, these stair-step exercise platforms typically include a single platform surface supported by risers at ends thereof. The risers may be extendable to allow the platform surface to be located at one of a number of predetermined heights. This configuration is considered inadequate, however, because all of a person's weight is transferred to the floor through the risers, which makes the platform somewhat unsteady and, at larger heights unstable, as a person is stepping onto and off of the platform. Furthermore, the extendable risers require numerous movable parts which makes this stair-step exercise platform less reliable than one requiring fewer movable parts. These numerous parts also make these platforms more difficult to manufacture.

To overcome these disadvantages, it is desirable to provide an individual stair-step exercise platform which can be easily adjusted in height either before or during an exercise routine, one which is sturdy at any configurable height, one which is portable and one which is made from simple and inexpensive materials to enable ease in manufacturing.

SUMMARY OF THE INVENTION

In accordance with one aspect of the present invention, an exercise platform for supporting a person at first and second heights comprises a first support having an upwardly disposed flat surface at a first height for supporting a person at the first height and a second support including a second flat surface for supporting the person at a second height. The second support is movable between first and second positions such that when the second support is located in the first position, the second support is removed from the first flat surface and such that when the second support is located in the second position, the second support lies immediately above the first flat surface so that the second flat surface is upwardly disposed at the second height. A connector connects the first and second supports to enable the second support to be moved between the first and second positions.

Preferably, the connector includes a hinge which enables the second support to be rotated between the first and second positions. Also preferably, the first and second surfaces include a high friction coefficient material, such as rubberized foam, disposed thereon. Still further, the platform includes a handle to make the platform portable.

According to another aspect of the present invention, an exercise platform for use in a stair-step exercise routine and capable of supporting a person at a plurality of heights above a floor, comprises a base section having first and second upwardly facing, flat surfaces at first and second heights above the floor, respectively. Furthermore, the exercise platform includes a riser section which is supported above the base section and includes third and fourth flat, oppositely facing surfaces. The riser section is movable between first and second positions such that the third surface is upwardly disposed and is located at a third height when the riser section is in the first position and such that the fourth surface is upwardly disposed and is located at a fourth height when the riser section is in the second position. Still further, the exercise platform includes a hinge which connects the riser section to the base section and enables the riser section to be rotated between the first and second positions.

Preferably, the riser section and the base section are configured so that the second height is equal to the third height. Furthermore, the base section includes a first support section having the first flat surface as an upper surface thereof and a second support section having the second flat surface as an upper surface thereof. The second support section is connected to the first support section so that the second flat surface is lower than the first flat surface.

In an alternative embodiment, the first support section may include first and second members and a further hinge which connects the first and second members and enables the second member to be rotated about the first member from a first position to a second position. Also, the second member includes a fifth flat surface which is downwardly disposed and adjacent to the floor when the second member is in the first position and which is upwardly disposed at a fifth height when the second member is in the second position. Preferably, the riser section and the base section are made of plastic and one or both of these sections include a handle.

According to another aspect of the present invention, a method of configuring an exercise device for use in a stair-step exercise routine comprises the steps of providing a support structure having upwardly disposed first and second flat surfaces at first and second heights, respectively, and moving a support member between first and second positions. Preferably, the support member is connected to the support structure with a hinge and has third and fourth oppositely facing flat surfaces so that the third flat surface is upwardly disposed at a third height when the support member is in the first position and the fourth flat surface is upwardly disposed at a fourth height when the support member is in the second position.

DESCRIPTION OF THE PREFERRED EMBODIMENT

Figure 1:
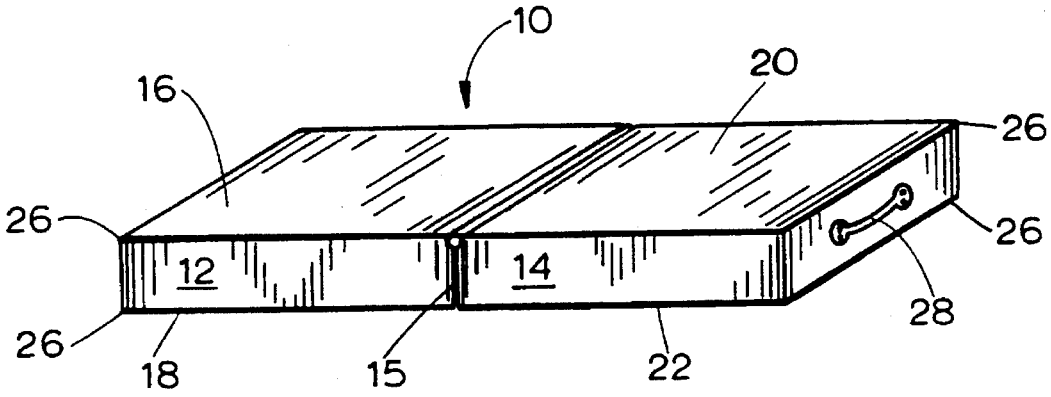
FIG. 1 is a perspective view of a first embodiment of the exercise platform according to the present invention and includes a support member located in a first position.
Figure 2:
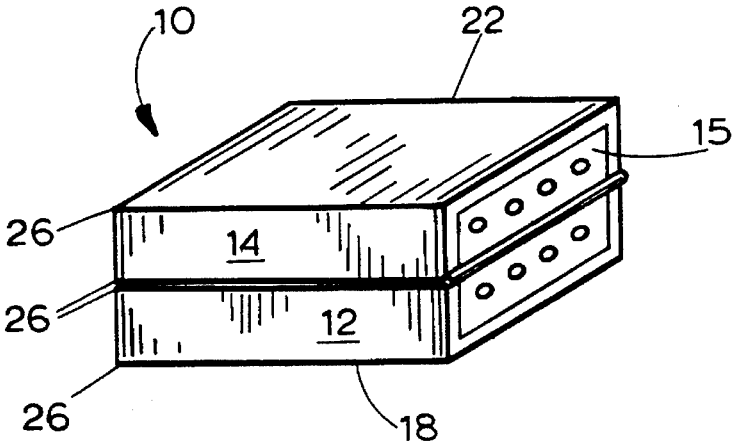
FIG. 2 is a perspective view of the exercise platform of FIG. 1 and includes the support member located in a second position.

Referring now to FIGS. 1 and 2, a first embodiment of an exercise platform, denoted generally by the reference numeral 10, is shown. The exercise platform 10 includes two support sections 12 and 14 which are formed of a light-weight but sturdy material such as plastic. The support sections 12 and 14 are connected with a hinge 15 which has an axis of rotation near an upper edge of the support sections 12 and 14 which enables the support sections 12 and 14 to rotate with respect to each other so that one of the support sections can rest on top of the other, as shown in FIG. 2.

Each of the support sections 12 and 14 are box-shaped having transverse walls and flat upper and lower surfaces. Thus, with reference to FIG. 1, the support section 12 has a flat upper surface 16 and a flat lower surface 18 while the support section 14 has a flat upper surface 20 and a flat lower surface 22. The flat surfaces 16, 18, 20 and 22 have a thin layer of a high friction coefficient material 26, such as, rubberized foam, disposed thereon. The exercise platform 10 may include a handle 28 which is formed of, for example, plastic, and which is screwed or riveted into, or formed as part of, one of the transverse walls of the support section 14. The handle 28 may, however, be attached to any other desired surface of the exercise platform 10.

Preferably, the flat upper surfaces 16 and 20 are parallel and at the same height and the hinge 15 is positioned so that the top of the hinge 15 is at either the same height or lower than the height of the flat surfaces 16 and 20 when the exercise platform is positioned as shown in FIG. 1. The support sections 12 and 14 may, for example, each be approximately 38 inches long, 20 inches wide and four inches high while the material 26 is one eighth of an inch thick. However, other desired dimensions can be used.

In use, a person places the exercise platform 10 on a floor in a first position, as shown in FIG. 1, and steps onto and off of either one or both of the flat surfaces 16 and 20 during the stair-step exercise routine. If the person, however, desires a higher platform, the person rotates the support section 14 about the hinge 15 until the support section 14 is located in a second position and rests on top of the support section 12, as shown in FIG. 2. In this second configuration, the person steps onto and off of the flat surface 22 during the stair-step exercise routine. It should be noted, that the support section 12 can instead, be rotated about the hinge 15 until it rests on top of the support section 14, in which case, the person steps onto the flat surface 18 while the flat surface 22 is adjacent the floor.

Because the exercise platform 10 distributes the weight of the person across the entire flat surfaces 16, 18, 20 and 22 the exercise platform 10 is highly stable. Furthermore, the high friction coefficient material 26 provides slip-free surfaces for the person to step onto and also provides friction between the exercise platform 10 and the floor to prevent the exercise platform 10 from slipping on the floor while being used. Still further, the exercise platform 10 is easily configurable in height, enabling a person to choose between a first height, as shown in FIG. 1, and a second height, as shown in FIG. 2, with only a simple movement of one of the support sections 12 or 14.

Figure 3:
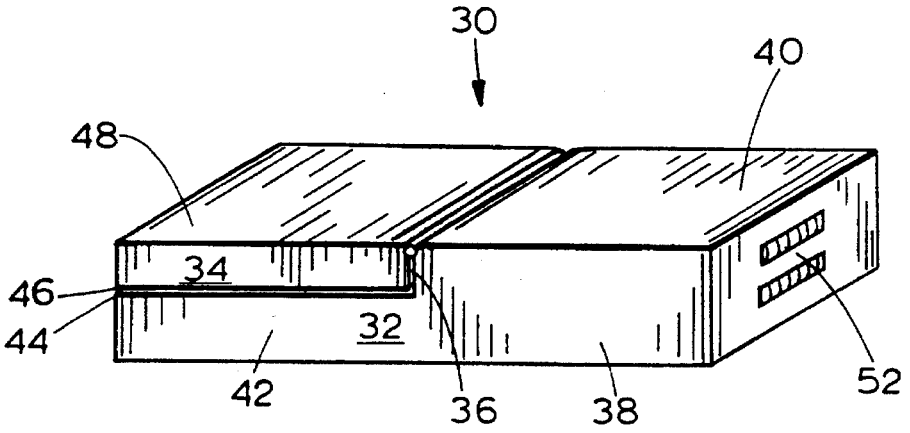
FIG. 3 is a perspective view of a second embodiment of the exercise platform according to the present invention and includes a support member located in a first position.
Figure 4:
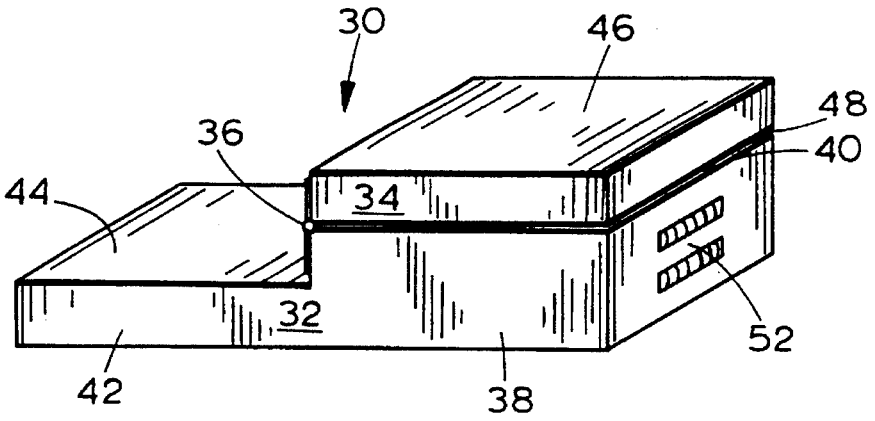
FIG. 4 is a perspective view of the exercise platform of FIG. 3 and includes the support member located in a second position.

Referring now to FIGS. 3 and 4, a second embodiment of the exercise platform, denoted generally as 30, is shown. The exercise platform 30 includes a base section 32 and a riser section 34 which is attached to the base section 32 by a hinge 36. The base section 32 includes a first support section 38 having an upper flat surface 40, as clearly shown in FIG. 3, and a second support section 42 having an upper flat surface 44, as clearly shown in FIG. 4. The riser section 34 includes two oppositely facing, flat surfaces 46 and 48. Furthermore, a handle 52 may be formed into the base section 32 as shown in FIGS. 3 and 4 or alteratively, the handle 52 may be located on any desired portion of the exercise platform 30 and/or may comprise a handle made of any other desired material.

Preferably, the flat surfaces 40, 44, 46, and 48 include a thin sheet, for example, one-eighth of an inch, of high friction coefficient material, such as rubberized foam, disposed thereon to prevent slippage between the exercise platform 10 and the foot of a person stepping thereon. Also, preferably, the bottom of the base section 32 includes rubber or other high friction material to prevent slippage between the base section 32 and the floor.

In this configuration, the riser section 34 rotates about the hinge 36 from a first position, as shown in FIG. 3, to a second position, as shown in FIG. 4. In the first position, the flat surface 48 is upwardly disposed and, preferably, is at the same height as the flat upper surface 40. In the second position, the flat surface 46 is upwardly disposed at a height defined by the heights of the riser section 34 and the first support section 38.

In this manner, the exercise platform 30 can be configured to provide a support surface at three different heights. Specifically, when the riser section 34 is located in the first position, as shown in FIG. 3, a person can step onto an intermediate height surface defined by either the flat surfaces 40 or 48. However, when the riser section 34 is located in the second position, as shown in FIG. 4, a person can step on a lower surface defined by the flat surface 44 or on a higher surface defined by the flat surface 46.

Preferably the support sections 38 and 42 and the riser section 34 are 38 inches long and 20 inches wide, although any other desired dimensions can be used. Also preferably, the first support section 38 is six inches high, the second support section 42 is four inches high and the riser section 34 is two inches high. With this configuration, or in any configuration having heights proportional to these, the exercise platform 30 can be configured to provide two stairs of equal height, as is shown in FIG. 4 wherein the float surface 46 is at approximately double the height of the flat surface 44. Thus, with the exercise platform 30 configured as shown in FIG. 4, a person may step from the floor to the flat surface 44 and then back to the floor, or step from the floor to the second flat surface 46 and back to the floor or, alternatively, step from the floor to the flat surface 44 and then to the flat surface 46 and then step back down to the floor in any desired manner. Furthermore, the person may alternate between these movements as desired.

Figure 5:
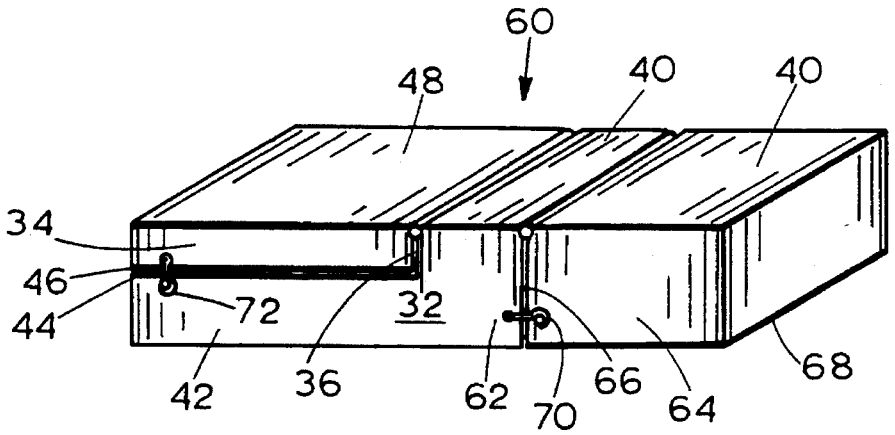
FIG. 5 is a perspective view of a third embodiment of the exercise platform according to the present invention.

A third embodiment of an exercise platform, denoted generally as 60, is shown in FIG. 5. The exercise platform 60, is similar to the exercise platform 30 shown in FIGS. 3 and 4, and like components are numbered identically. The exercise platform 60, however, includes a base section 32 having first and second support members 62 and 64, respectively. The support members 62 and 64 are connected by a hinge 66 and have upper surfaces which, together, form the upper surface 40. The second support member 64 includes a further flat surface 68 which is disposed oppositely from the flat surface 40 and which includes a thin layer of high friction coefficient material disposed thereon. The second support member 64 can be rotated about the hinge 66 so that it rests on top of the first support member 62 and partially on top of the riser 34. In such a configuration, the flat surface 68 is upwardly disposed at a further height for use in a stair-step exercise routine.

When using the exercise platform 60, a person can choose to step on the surfaces 40 and/or 48 when the exercise platform 60 is configured as shown in FIG. 5 or can, instead, rotate the riser section 34 about the hinge 36 and step on either of the surfaces 44 or 46 or, alternatively, can rotate the support member 64 about the hinge 66 and step on either of the surfaces 48 or 68.

Preferably the top of the hinge 66 is located at the same level or is lower than the upper surface 40. Furthermore, hooks 70 and 72 can be conveniently attached to opposite sides of the riser section 34 or the base section 32 to provide more stability during use thereof. Similar hooks can be used in any of the embodiments shown in FIGS. 1–4. Still further, the hinges shown in FIGS. 1–5 may be replaced with velcro or other desired connectors placed on any desired surface of any of the exercise platforms shown in FIGS. 1–5 to allow movement between the individual pieces thereof.

Numerous modifications and alternative embodiments of the invention will be apparent to those skilled in the art in view of the foregoing description. Accordingly, this description is to be construed as illustrative only. The details of the structure may be varied substantially without departing from the spirit of the invention, and the exclusive use of all modifications, which are within the scope of the appended claims, is reserved.

It is claimed:

1. An exercise device for supporting a person at a plurality of heights, the platform comprising:

first supporting means for supporting the person at first and second heights, wherein the first supporting means includes first and second flat, parallel surfaces which support the person at the first and second heights, respectively;

second supporting means for supporting a person above the first supporting means, including third and fourth flat, parallel and oppositely facing surfaces, wherein the second supporting means is switchable between first and second positions such that the second supporting means lies immediately above the first flat surface so that the third flat surface is upwardly disposed at a third height when the second supporting means is in the first position and such that the second supporting means lies immediately above the second flat surface so that the fourth flat surface is upwardly disposed at a fourth height when the second supporting means is located in the second position; and connecting means for connecting the second supporting means to the first supporting means to enable the second supporting means to be switchable between the first and second positions;

wherein the entire weight of the second supporting means is supported by a combination of the first flat surface and the connecting means when the second supporting means is located in the first position and the entire weight of the second supporting means is supported by a combination of the second flat surface and the connecting means when the second supporting means is located in the second position.

2. An exercise device for supporting a person at a plurality of heights as set forth in claim 1, wherein the second height is equal to the third height.

3. An exercise device for supporting a person at a plurality of heights as set forth in claim 1, wherein the connecting means comprises a hinge.

4. An exercise device for supporting a person at a plurality of heights as set forth in claim 1, wherein at least one of the first, second, third or fourth flat surfaces includes a high friction coefficient material disposed thereon.

5. An exercise device for supporting a person at a plurality of heights as set forth in claim 4, wherein the high friction coefficient material is rubberized foam.

6. An exercise device for supporting a person at a plurality of heights as set forth in claim 1, wherein the first supporting means includes a first support section having the first flat surface at a top thereof and wherein the first supporting means includes a second support section having the second flat surface at a top thereof, wherein the second support section is connected to the first support section so that the second flat surface is lower than the first flat surface.

7. An exercise device for supporting a person at a plurality of heights as set forth in claim 6, wherein the second supporting means is box-shaped and wherein the connecting means includes a hinge which is connected to the first supporting means and to the second supporting means to enable the second supporting means to be rotated with respect to the first supporting means.

8. An exercise device for supporting a person at a plurality of heights as set forth in claim 1, wherein the first and second supporting means are formed of plastic.

9. An exercise device for supporting a person at a plurality of heights as set forth in claim 1, further including a handle.

10. An exercise device for supporting a person at a plurality of heights as set forth in claim 1, wherein the entire second supporting means lies directly above the first flat surface when the second supporting means is located in the first position and the entire second supporting means lies directly above the second flat surface when the second supporting means is located in the second position.

11. An exercise device for supporting a person at a plurality of heights as set forth in claim 10, wherein the first, second, third and fourth flat surfaces have equal lengths and have equal widths.

12. An exercise platform for use in a stair-step exercise routine and capable of supporting a person at a plurality of heights above a floor, comprising:

a base section having first and second upwardly facing, flat surfaces at first and second heights above the floor, respectively, which are capable of supporting the person;

a riser section which is supported by the base section and includes third and fourth flat, oppositely facing surfaces, wherein the riser section is movable between first and second positions such that the third surface is upwardly disposed and is located at a third height when the riser section is in the first position and such that the fourth surface is upwardly disposed and is located at a fourth height when the riser section is in the second position and wherein the entire riser section is positioned directly above the first surface when the riser section is in the first position and the entire riser section is positioned directly above the second surface when the riser section is in the second position; and a hinge which connects the riser section to the base section and enables the riser section to be rotated between the first and second positions.

13. An exercise platform for use in a stair-step exercise routine and capable of supporting a person at a plurality of heights above a floor as set forth in claim 12, wherein the second height is equal to the third height.

14. An exercise platform for use in a stair-step exercise routine and capable of supporting a person at a plurality of heights above a floor as set forth in claim 12, wherein the base section and the riser section are formed of plastic.

15. An exercise platform for use in a stair-step exercise routine and capable of supporting a person at a plurality of heights above a floor as set forth in claim 12, further including a handle.

16. An exercise platform for use in a stair-step exercise routine and capable of supporting a person at a plurality of heights above a floor as set forth in claim 12, wherein the riser section transfers the entire weight of a person located on the third surface of the riser section to a combination of the first surface of the base section and the hinge when the riser section is in the first position and wherein the riser section transfers the entire weight of a person on the fourth surface of the riser section to a combination of the second surface of the base section and the hinge when the riser section is located in the second position.

17. An exercise platform for use in a stair-step exercise routine and capable of supporting a person at a plurality of heights above a floor as set forth in claim 12, wherein the second height is one and one-half (1½) times the first height.

18. An exercise platform for use in a stair-step exercise routine and capable of supporting a person at a plurality of heights above a floor as set forth in claim 12, wherein the base section includes a first support section having the first flat surface as an upper surface thereof, and a second support section having the second flat surface as an upper surface thereof, wherein the second support section is connected to the first support section so that the second flat surface is higher than the first flat surface.

19. An exercise platform for use in a stair-step exercise routine and capable of supporting a person at a plurality of heights above a floor as set forth in claim 18, wherein the second support section also includes first and second members and a further hinge which connects the first and second members and enables the second member to be rotated about the first member from a first position to a second position, and wherein the second member includes a fifth flat surface which is downwardly disposed and adjacent the floor when the second member is in the first position and which is upwardly disposed at a fifth height when the second member is in the second position.

20. An exercise platform for use in a stair-step exercise routine and capable of supporting a person at a plurality of heights above a floor as set forth in claim 12, wherein at least one of the first, second, third or fourth flat surfaces includes a high friction coefficient material disposed thereon.

21. An exercise platform for use in a stair-step exercise routine and capable of supporting a person at a plurality of heights above a floor as set forth in claim 20, wherein the high friction coefficient material is rubberized foam.

* * * * *